US011626076B2

(12) United States Patent
Yu

(10) Patent No.: US 11,626,076 B2
(45) Date of Patent: Apr. 11, 2023

(54) DISPLAY DEVICE AND PIXEL CIRCUIT HAVING AN ON-BIAS CONTROL

(71) Applicant: LG Display Co., Ltd., Seoul (KR)

(72) Inventor: Jaesung Yu, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/553,740

(22) Filed: Dec. 16, 2021

(65) Prior Publication Data

US 2022/0208110 A1 Jun. 30, 2022

(30) Foreign Application Priority Data

Dec. 28, 2020 (KR) ..... 10-2020-0185058

(51) Int. Cl.

| | |
|---|---|
| ***G09G 3/3266*** | (2016.01) |
| ***G09G 3/3291*** | (2016.01) |
| ***G09G 3/3258*** | (2016.01) |
| ***G09G 3/3208*** | (2016.01) |
| ***G09G 3/3275*** | (2016.01) |

(52) U.S. Cl.

CPC ..... *G09G 3/3266* (2013.01); *G09G 3/3291* (2013.01); *G09G 2300/0426* (2013.01); *G09G 2300/0876* (2013.01)

(58) Field of Classification Search

None

See application file for complete search history.

(56) References Cited

U.S. PATENT DOCUMENTS

| | | | | |
|---|---|---|---|---|
| 8,077,126 | B2 * | 12/2011 | Lee | G09G 3/3233 345/92 |
| 10,297,781 | B2 * | 5/2019 | Yoon | G09G 3/3233 |
| 10,304,380 | B2 * | 5/2019 | Zhu | G09G 3/3233 |
| 10,360,840 | B2 * | 7/2019 | Matsueda | G09G 3/3233 |
| 10,614,758 | B2 * | 4/2020 | Kim | H01L 27/3265 |
| 11,271,181 | B1 * | 3/2022 | Yang | H01L 51/5012 |
| 2010/0079361 | A1 * | 4/2010 | Lee | G09G 3/3233 345/77 |
| 2017/0092178 | A1 * | 3/2017 | Lee | H01L 27/1251 |
| 2017/0140724 | A1 * | 5/2017 | Lin | G09G 3/3233 |
| 2018/0005576 | A1 * | 1/2018 | Yoon | G09G 3/3233 |
| 2018/0006263 | A1 * | 1/2018 | Yoon | H01L 51/5212 |
| 2018/0061915 | A1 * | 3/2018 | Yu | H01L 27/3265 |

FOREIGN PATENT DOCUMENTS

KR 10-2019-0072200 A 6/2019

* cited by examiner

*Primary Examiner* — Sepehr Azari

(74) *Attorney, Agent, or Firm* — Seed IP Law Group LLP

(57) ABSTRACT

A display device includes a display panel having scan lines, data lines, and sub-pixels disposed therein; a scan driver which drives the scan lines; and a data driver which drives the data lines. Each of the sub-pixels includes: a light emitting element; a driving transistor which drives the light emitting element; a 3-1th transistor electrically connected between a first node of the driving transistor and a high potential voltage; a 1-1th transistor and a 1-2th transistor each electrically connected between a second node of the driving transistor and a 1-1th or 1-2th data line, respectively; a second transistor electrically connected between a third node of the driving transistor and an initialization voltage line; a first capacitor connected between the second node and an anode electrode of the light emitting element; and a second capacitor connected between the high potential voltage and the anode electrode.

22 Claims, 13 Drawing Sheets

DISPLAY DEVICE AND PIXEL CIRCUIT HAVING AN ON-BIAS CONTROL

BACKGROUND

Technical Field

The present disclosure relates to a display device including an electroluminescence device.

Description of the Related Art

An electroluminescence device is classified broadly into an inorganic light emitting display device and an organic light emitting display device, depending on the material of a light emitting layer. Among them, an active-matrix type organic light emitting display device includes an organic light emitting diode (OLED) which emits light by itself and is representative electroluminescence diode. The active-matrix type organic light emitting display device has a rapid response speed, a high light emission efficiency, a high luminance, and a wide view angle.

In the organic light emitting display device having the above advantages, differences in characteristics such as mobility and a threshold voltage Vth of a driving TFT occur for each pixel due to a process, etc., and a voltage drop of a high potential voltage VDD occurs. Therefore, the amount of current which drives the organic light emitting device varies, so that a luminance deviation occurs between pixels.

In general, there is a problem that unintentional spots or patterns are generated on the screen due to the difference in characteristics of the initial driving TFT, and there is a problem that the characteristic difference due to the degradation of the driving TFT, which occurs while driving the organic light emitting device, reduces the lifespan of an organic light emitting display panel or generates an after-image. Accordingly, attempts to improve an image quality by reducing luminance deviation between pixels are being continued by compensating characteristic deviation of the driving TFT and by adopting a compensation circuit for compensating for the voltage drop of the high potential voltage VDD.

In response to this, it was attempted to reduce the power consumption of the organic light emitting display device by variously changing a driving method of the organic light emitting display device. One of these driving methods reduces a frequency for driving the organic light emitting display device than a fundamental driving frequency and controls a period for horizontally holding a light emitting state to be longer.

BRIEF SUMMARY

The inventors have realized that, when a low gradation is represented in driving methods in which the driving frequency is reduced and the horizontal holding period is lengthened, there is a problem that a normal luminance output is delayed for a certain period of time due to a threshold voltage Vth of the driving TFT. This output luminance delay phenomenon causes flicker in the display panel.

The present disclosure relates to a display device including an internal compensation circuit. The purpose of the present disclosure is to provide a display device which can be driven at a high speed and can reduce power consumption by separating data lines that supply a data voltage and a reference voltage. Also, the purpose of the display device according to the embodiments is that a plurality of transistors that control the light emission of a light emitting element are individually controlled, so that on-bias stress which alleviates hysteresis of a driving transistor is driven.

The present disclosure has the following embodiments.

One embodiment is a display device including: a display panel in which a plurality of scan lines, a plurality of data lines, and a plurality of sub-pixels are disposed; a scan driver which drives the plurality of scan lines; and a data driver which drives the plurality of data lines. Each of the plurality of sub-pixels includes: a light emitting element; a driving transistor which comprises a first node connected to a high potential voltage, a second node that is a gate node, and a third node electrically connected to an anode electrode of the light emitting element, and drives the light emitting element; a 3-1th transistor electrically connected between the first node and the high potential voltage; a 1-1th transistor electrically connected between the second node and a 1-1th data line; a 1-2th transistor electrically connected between the second node and a 1-2th data line; a second transistor electrically connected between the third node and an initialization voltage line; a first capacitor one end of which is connected to the second node and the other end of which is connected to the anode electrode; and a second capacitor one end of which is connected to the high potential voltage and the other end of which is connected to the anode electrode.

The display device is driven with the separation of a refresh period and a horizontal holding period, and wherein the refresh period comprises a first period, a second period, a third period, and a fourth period.

During the first period, the 1-1th transistor is turned off, the 1-2th transistor is turned on, the second transistor is turned on, and the 3-1th transistor is turned off.

During the second period, the 1-1th transistor is turned off, the 1-2th transistor is turned on, the second transistor is turned off, and the 3-1th transistor is turned on.

During the third period, the 1-1th transistor is turned on, the 1-2th transistor is turned off, the second transistor is turned off, and the 3-1th transistor is turned off.

During the fourth period, the 1-1th transistor, the 1-2th transistor, and the second transistor are turned off, and the 3-1th transistor is turned on.

Each of the sub-pixels further comprises a 3-2th transistor electrically connected between the third node and the anode electrode.

The refresh period further includes a bias period before the second period, and wherein, during the bias period, the 1-1th transistor is turned off, the 1-2th transistor is turned off, the second transistor is turned on, the 3-1th transistor is turned off, and the 3-2th transistor is turned off.

The bias period is between the first period and the second period.

The bias period is before the first period.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Hereinafter, embodiments of the present disclosure will be described with reference to the accompanying drawings. Throughout the disclosure, the same references mean substantially the same components. In the following description, the detailed description of known functions and configurations incorporated related to the present disclosure is omitted when it may make the subject matter of the present disclosure rather unclear. Also, the component names used in the following description may be selected in consideration of making it easier to write the specification and may be different from the component names of an actual product.

In describing the components of the present disclosure, terms such as the first, the second, A, B, (a), (b), etc., can be used. Such terms are used only to distinguish one component from other components, and the essence, order, or number, etc., of the component are not limited by the terms. When it is said that a component is "connected," "coupled" or "accessed" to another component, it should be understood that not only the component may be directly connected or accessed to that other component, but also another component may be "interposed" between respective components or each component may be "connected," "coupled," or "accessed" by other components.

Figure 1:
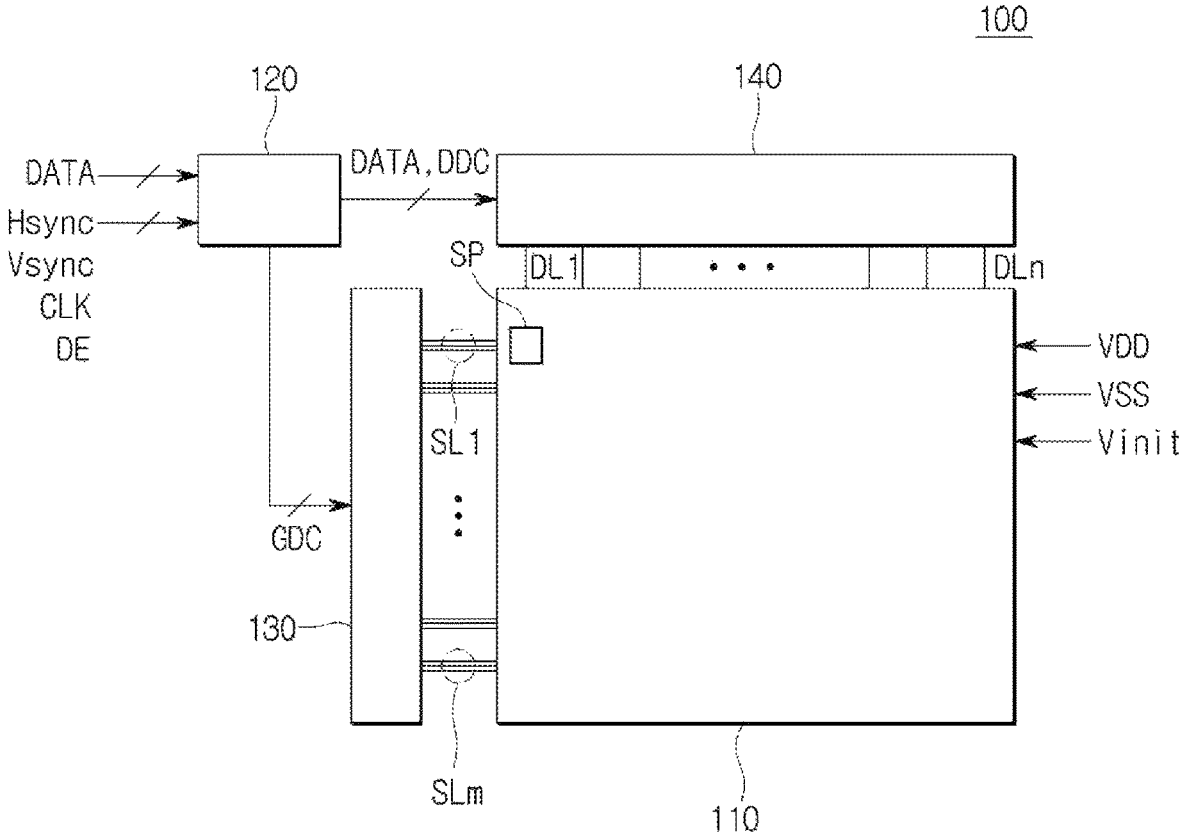
FIG. 1 is a schematic block diagram for describing a display device according to an embodiment.

FIG. 1 is a schematic block diagram for describing a display device according to an embodiment.

As shown in FIG. 1, the display device 100 according to the embodiment includes a display panel 110, a timing controller 120, a scan driver 130, and a data driver 140. According to various embodiments, the timing controller 120, the scan driver 130, and the data driver 140 may be configured as a single driver IC.

The display panel 110 includes sub-pixels SP that emit various colored lights. The sub-pixels SP include a red sub-pixel, a green sub-pixel, and a blue sub-pixel, and in some cases, a white sub-pixel. Meanwhile, in the display panel 110 including the white sub-pixel, a light emitting layer of each of the sub-pixels SP may emit white light without emitting red, green, and blue light. In this case, the emitted white light is converted into red, green, and blue light by a color conversion filter (e.g., an RGB color filter). Each sub-pixel SP includes one light emitting element EL (see FIG. 3), a driving element DT (see FIG. 3) which supplies a driving current to the light emitting element, a capacitor which maintains a driving voltage of the driving element, and at least one switching element. The light emitting element EL may be an organic light emitting device (OLED).

The sub-pixels SP included in the display panel 110 are driven based on not only a data signal DATA and a scan signal SCAN but also a high potential voltage VDD supplied through a first power line, a low potential voltage VSS supplied through a second power line, and an initialization voltage Vinit supplied through an initialization line. The display panel 110 displays a specific image on the basis of the sub-pixels SP that emit light in response to a drive signal supplied from the data driver 140, the scan driver 130, etc.

The timing controller 120 controls operation timings of the data driver 140 and the scan driver 130 by using timing signals such as a vertical synchronization signal Vsync, a horizontal synchronization signal Hsync, a data enable signal DE, and a clock signal CLK, etc., supplied from the outside. Since the timing controller 120 may determine a frame period by counting the data enable signal DE of one horizontal period, the vertical synchronization signal Vsync and the horizontal synchronization signal Hsync supplied from the outside may be omitted. Control signals generated by the timing controller 120 include a gate timing control signal GDC for controlling the operation timing of the scan driver 130 and a data timing control signal DDC for controlling the operation timing of the data driver 140.

The scan driver 130 generates the scan signal while shifting the level of a gate driving voltage in response to the gate timing control signal GDC supplied from the timing controller 120. The scan driver 130 supplies the scan signal through scan lines SL1 to SLm connected to the sub-pixels SP included in the display panel 110.

The data driver 140 samples and latches the data signal DATA supplied from the timing controller 120 in response to the data timing control signal DDC supplied from the timing controller 120 and converts it into data of a parallel data system. The data driver 140 converts the data signal DATA from a digital signal into an analog signal in response to a gamma reference voltage. The data driver 140 supplies the data signal DATA through data lines DL1 to DLn connected to the sub-pixels SP included in the display panel 110.

The display device 100 according to the embodiment may be driven while varying a driving frequency. Specifically, in the display device 100, the timing controller 120 may control a method for driving the display device 100 by adjusting a refresh rate through a refresh rate control signal. For example, the display device 100 may be driven at a refresh rate higher or lower than a reference refresh rate. In particular, when the display device 100 is driven at a refresh rate lower than the reference refresh rate, it is referred to as "low-speed driving" (also referred to as "low refresh rate driving"), and when the display device 100 is driven at a refresh rate higher than the reference refresh rate, it is referred to as "high-speed driving".

Here, the low-speed driving means driving at a refresh rate lower than the reference refresh rate of 60 Hz, which means driving the display device 100 in such a way as to output a smaller number than 60 of frames for one second. That is, when the refresh rate is 60 Hz, 60 frames are driven for one second, and driving at a refresh rate lower than 60 Hz is referred to as low-speed driving. For example, the refresh rate of the low-speed driving may be 1 Hz, and the low-speed driving at 1 Hz may output only one frame for one second. The display device 100 according to the embodiment may be driven in a low power consumption mode, and the refresh rate in the low power consumption driving mode may be reduced to 1 Hz.

Hereinafter, the low-speed driving in the display device will be described in detail with reference to FIG. 2.

Figure 2:
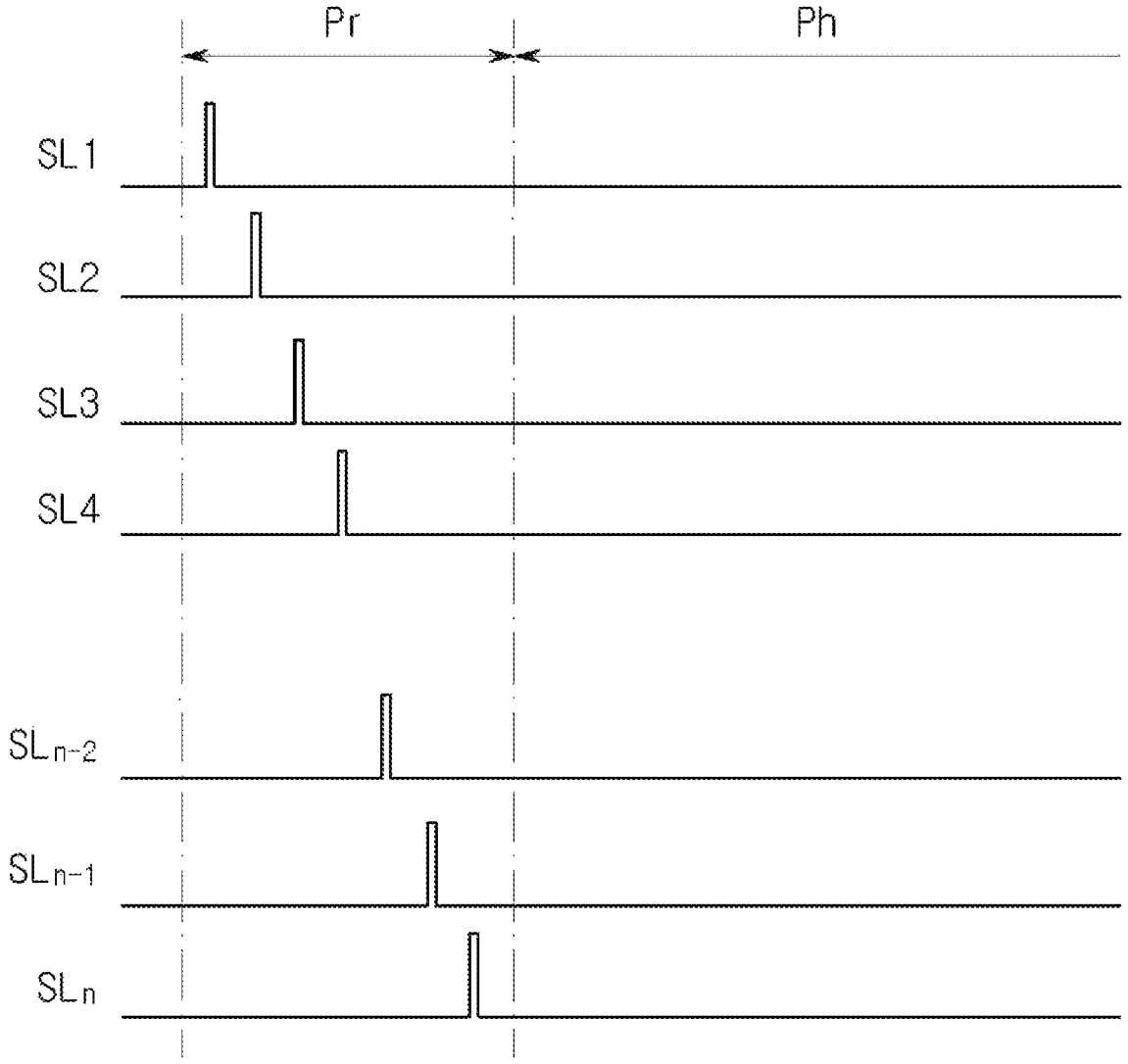
FIG. 2 is a waveform diagram showing a scan signal in a low-speed driving mode of the display device according to the embodiment.

FIG. 2 is a waveform diagram showing the scan signal in a low-speed driving mode of the display device according to the embodiment.

Referring to FIG. 2, in order to reduce power consumption of the display device, in the low-speed driving mode, a horizontal holding period Ph can be controlled to be longer for a unit time, and a refresh period Pr can be controlled to be shorter.

Here, the horizontal holding period Ph means a period in which that a data voltage Vdata is not supplied through the data lines DL connected to the light emitting elements EL respectively, and the light emitting elements EL emit light even though a reference voltage Vref is applied.

The refresh period Pr includes an initialization period in which the initialization voltage Vinit is applied to the light emitting element EL such that the light emitting element EL is able to emit light during the horizontal holding period Ph, a sampling period in which a threshold voltage Vth of the driving element which supplies a driving current to the light emitting element EL is sampled or sensed, and a programming period in which the data voltage Vdata is stored in the capacitor connected to the light emitting element EL.

For example, in the low-speed driving mode, the refresh period Pr can be maintained for 16.6 milliseconds (hereinafter, msec) of one second, and the horizontal holding period Ph can be maintained for 983.4 msec. However, the present disclosure is not limited thereto, and in the low-speed driving mode, the refresh period Pr may be a period corresponding to a plurality of frames.

Referring to FIG. 2, the scan signal supplied to each of the scan lines SL is sequentially shifted during the refresh period Pr and is supplied to a sub-pixel SP. Specifically, the scan signal is sequentially shifted and supplied during the refresh period Pr from the first scan line SL1 to the n-th scan line SLn. Here, n means the total number of scan lines in the display device.

Accordingly, the light emitting element EL emits light during the horizontal holding period Ph by the data voltage Vdata sampled and programmed in the refresh period Pr.

In order to reduce the power consumption in a still image, the display device 100 according to the embodiment can reduce the refresh rate as shown in the example of FIG. 2 to drive the pixels at a low speed. In this case, since a data update cycle becomes longer, flicker may occur when a leakage current occurs in the pixel. The flicker may be viewed and recognized when the luminance of the pixels is periodically changed.

Figure 3:
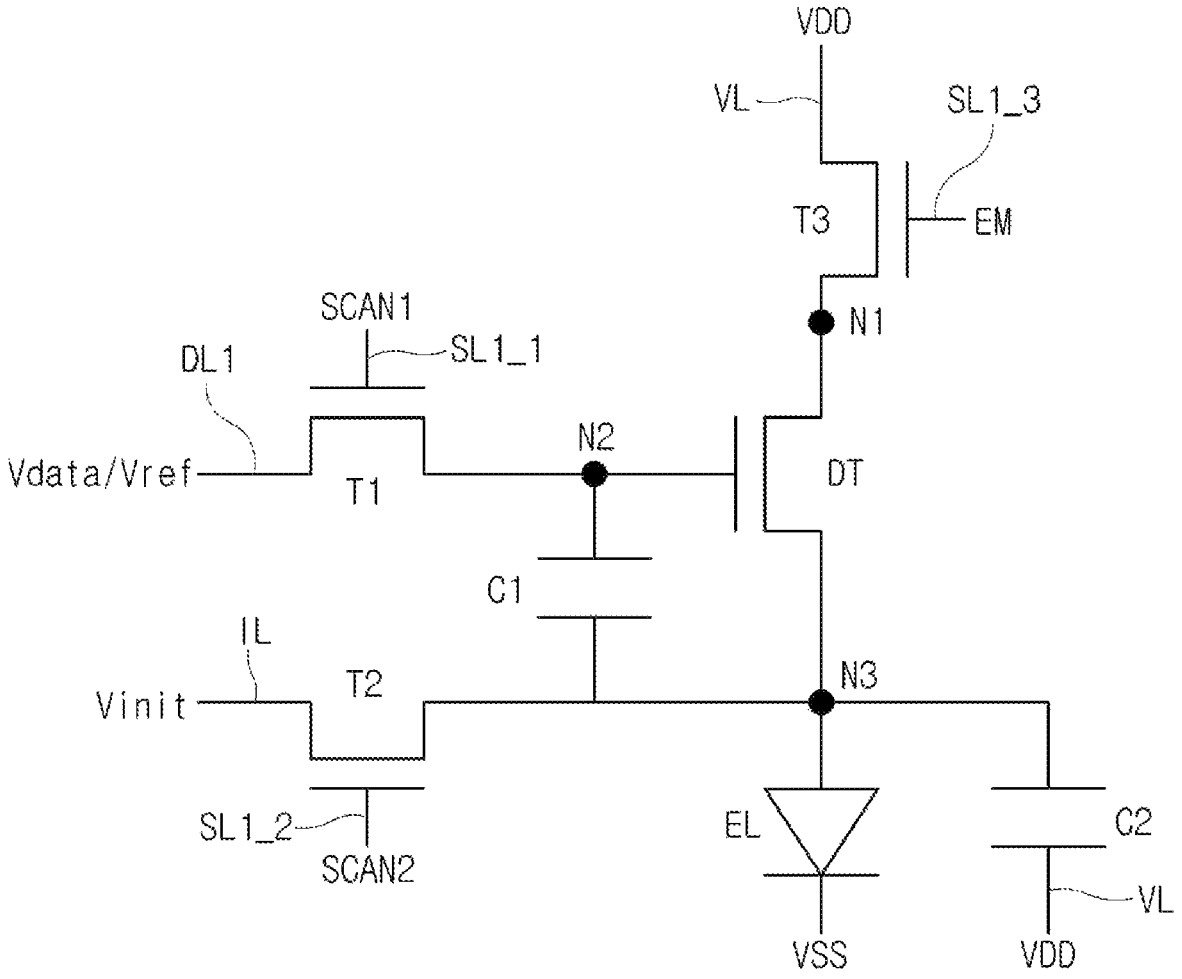
FIG. 3 is a circuit diagram of a 4T2C sub-pixel according to a comparison example.

FIG. 3 is a circuit diagram of a 4T2C sub-pixel according to a comparison example.

The sub-pixel SP included in the display panel 110 includes 4T (Transistor) and 2C (Capacitor) including first to third transistors T1 to T3, the light emitting element EL, a driving transistor DT, and first and second capacitors C1 and C2.

Hereinafter, a connection relationship between components included in the sub-pixel SP and their roles will be briefly described as follows.

The driving transistor DT includes a gate node that is a second node N2 connected to the first transistor T1, a source node that is a third node N3 connected to the second transistor T2, and a drain node that is a first node N1 connected to the third transistor T3.

Specifically, the gate node of the driving transistor DT is electrically connected to the data line DL1 that supplies the data voltage Vdata and the reference voltage Vref. Accordingly, the gate node of the driving transistor DT is connected to the source node of the first transistor T1 and receives the data voltage Vdata and the reference voltage Vref. The drain node of the driving transistor DT is electrically connected to the high potential voltage VDD through a power wiring VL. Accordingly, the drain node of the driving transistor DT is connected to the source node of the third transistor T3 and receives the high potential voltage VDD. The source node of the driving transistor DT is electrically connected to the light emitting element EL. Specifically, the source node of the driving transistor DT is connected to an anode of the light emitting element EL and is connected to the source node of the second transistor T2.

Accordingly, when the third transistor T3 is turned on by a light emission control signal EM and the driving transistor DT is also turned on, the driving transistor DT controls the magnitude of the current flowing through the light emitting element EL on the basis of a voltage applied to the gate node and the source node, and then controls the luminance of the light emitting element EL.

The first transistor T1 includes a gate node connected to a first scan signal line SL1_1, a drain node connected to the data line DL1, and a source node that is the second node N2 connected to the driving transistor DT. Specifically, the gate node of the first transistor T1 is connected to the first scan line SL1_1 and is turned on or off by a first scan signal SCAN1. The drain node of the first transistor T1 is connected to the data line DL1 and transmits the data voltage Vdata and the reference voltage Vref to the gate node of the driving transistor DT.

Accordingly, when the first scan signal SCAN1 is in a high state, the first transistor T1 is turned on and supplies the data voltage Vdata and the reference voltage Vref to the gate node of the driving transistor DT.

The second transistor T2 includes a gate node connected to a second scan line SL1_2, a drain node connected to an initialization voltage line IL, and a source node connected to the source node of the driving transistor DT. Specifically, in the gate node of the second transistor T2, when a second scan signal SCAN2 is in a high state, the second transistor T2 is turned on. The second transistor T2 supplies the initialization voltage Vinit to the third node N3. Accordingly, when the second scan signal SCAN2 is in a high state, the second transistor T2 is turned on and supplies the initialization voltage Vinit to the third node N3, so that the data voltage Vdata written in the light emitting element EL is initialized.

The third transistor T3 includes a gate node connected to a third scan line SL1_3, a drain node connected to the high potential voltage VDD, and a source node connected to the drain node of the driving transistor DT. Specifically, the gate node of the third transistor T3 is connected to the third scan line SL1_3, and when the light emission control signal EM is in a high state, the third transistor T3 is turned on. The drain node of the third transistor T3 is directly connected to the high potential voltage VDD. Accordingly, when the light emission control signal EM is in a high state, the third transistor T3 is turned on and supplies the high potential voltage VDD to the drain node of the driving transistor DT, so that the driving transistor DT controls the amount of current of the light emitting element EL by the data voltage Vdata.

The two capacitors may be storage capacitors which store a voltage applied to the gate node or the source node of the driving transistor DT. Also, the two capacitors are connected in series at the source node of the driving transistor DT.

Specifically, the first capacitor C1 is electrically connected to the second node N2 that is the gate node of the driving transistor DT and to the third node N3 that is the source node of the driving transistor DT. Accordingly, the first capacitor C1 stores a voltage equal to a difference between the voltages applied to the second node N2 and the third node N3.

The second capacitor C2 is electrically connected to the high potential voltage VDD and the third node N3 that is the source node of the driving transistor DT. Also, the second capacitor C2 is connected in series with the first capacitor C1 at the third node N3. Then, the second capacitor C2, together with the first capacitor C1, stores a voltage by voltage-division.

For example, the first capacitor C1 stores and samples the threshold voltage Vth of the driving transistor DT by a voltage difference between the second node N2 and the third node N3. Also, when the data voltage Vdata is applied, the first capacitor C1 stores and programs a voltage determined by voltage division with the second capacitor C2. That is, the first capacitor C1 and the second capacitor C2 sample the threshold voltage Vth of the driving transistor DT in a source-follower manner. When the potentials of the second node N2 and the third node N3 change, the first capacitor C1 and the second capacitor C2 store the potentials of the second node N2 and the third node N3 respectively through the voltage division.

The sub-pixel SP emits light after going through an initialization operation (Initial), a sampling operation (Sampling), and a data writing operation (Data Writing). This will be described in detail as follows.

Initialization Period Ti

Figure 4:
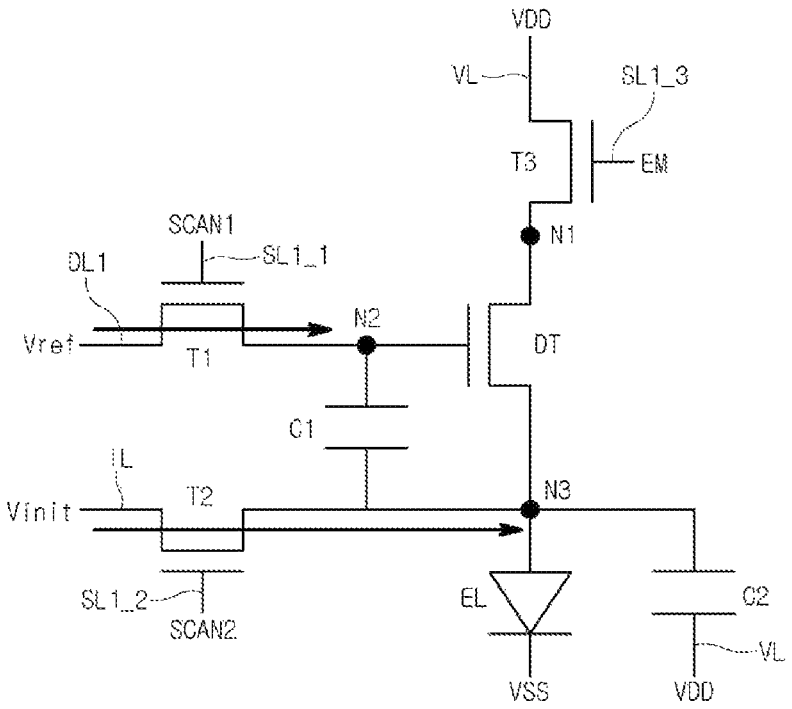
FIG. 4 shows operation of a pixel circuit shown in FIG. 3 in an initial period.
Figure 4:
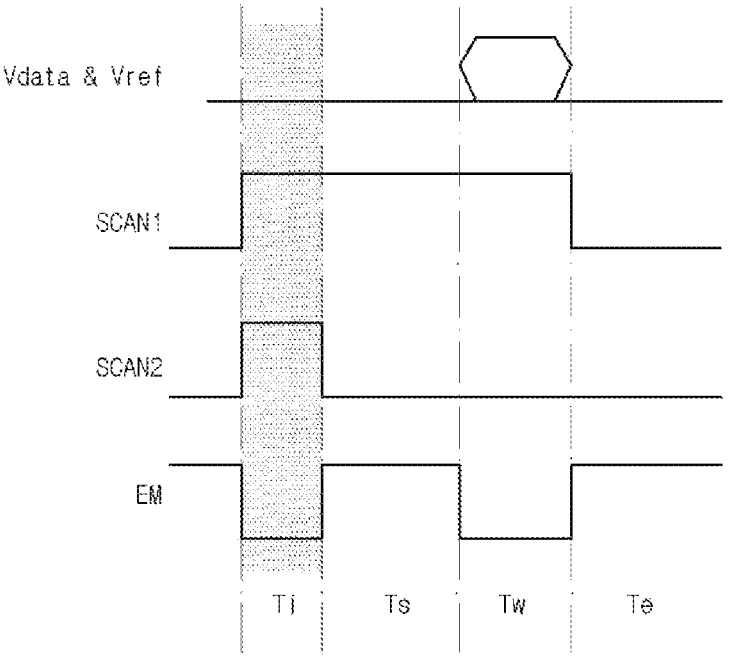

FIG. 4 shows that a pixel circuit shown in FIG. 3 operates in an initial period.

First, at the moment when the initialization period Ti starts, the first scan signal SCAN1 and the second scan signal SCAN2 rise to become in a high state, and at the same time, the light emission control signal EM falls to become in a low state. Accordingly, during the initialization period Ti, the first transistor T1 and the second transistor T2 are turned on, and the third transistor T3 is turned off. Accordingly, the reference voltage Vref is supplied to the second node N2 from the data line DL1 by the first transistor T1. Also, the initialization voltage Vinit is supplied to the third node N3 from the initialization voltage line IL by the second transistor T2. That is, as the initialization voltage Vinit is supplied to the third node N3 that is the source node of the driving transistor DT, the data voltage Vdata written in the light emitting element EL is initialized.

Sampling Period Ts

Figure 5:
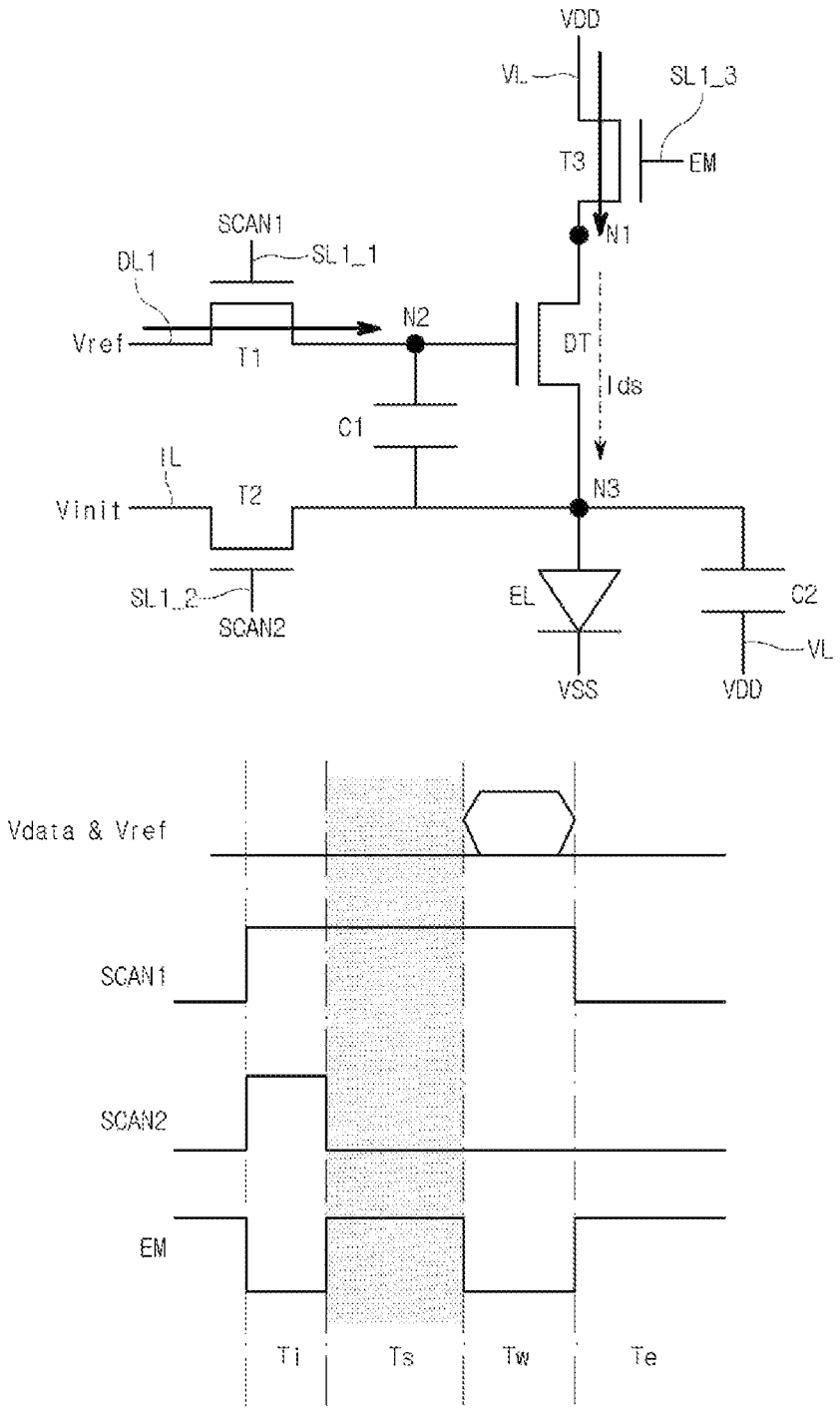
FIG. 5 shows operation of the pixel circuit shown in FIG. 3 in a sampling period.

FIG. 5 shows that the pixel circuit shown in FIG. 3 operates in a sampling period.

During the sampling period Ts, the first scan signal SCAN1 is maintained in a high state, and the second scan signal SCAN2 is maintained in a low state. At the moment when the sampling period Ts starts, the light emission control signal EM rises and is maintained in a high state during the sampling period Ts. Accordingly, during the sampling period Ts, the first transistor T1 and the third transistor T3 are turned on, and the second transistor T2 is turned off. Accordingly, the reference voltage Vref is supplied to the second node N2 through the turned-on first transistor T1, and the high potential voltage VDD is supplied to the drain node of the driving transistor DT through the turned-on third transistor T3. That is, during the sampling period Ts, the voltage of the second node N2 is maintained as the reference voltage Vref, and the voltage of the third node N3 rises by a current between the drain and the source (hereinafter, referred to as Ids) of the driving transistor DT. Here, a voltage between the gate and the source (hereinafter, referred to as Vgs) of the driving transistor DT is sampled as the threshold voltage Vth of the driving transistor DT in a source follower manner. The thus sampled threshold voltage Vth of the driving transistor DT is stored in the first capacitor C1. Accordingly, during the sampling period Ts, the voltage of the second node N2 is the reference voltage Vref, and the voltage of the third node N3 is Vref−Vth.

Data Writing Period Tw

Figure 6:
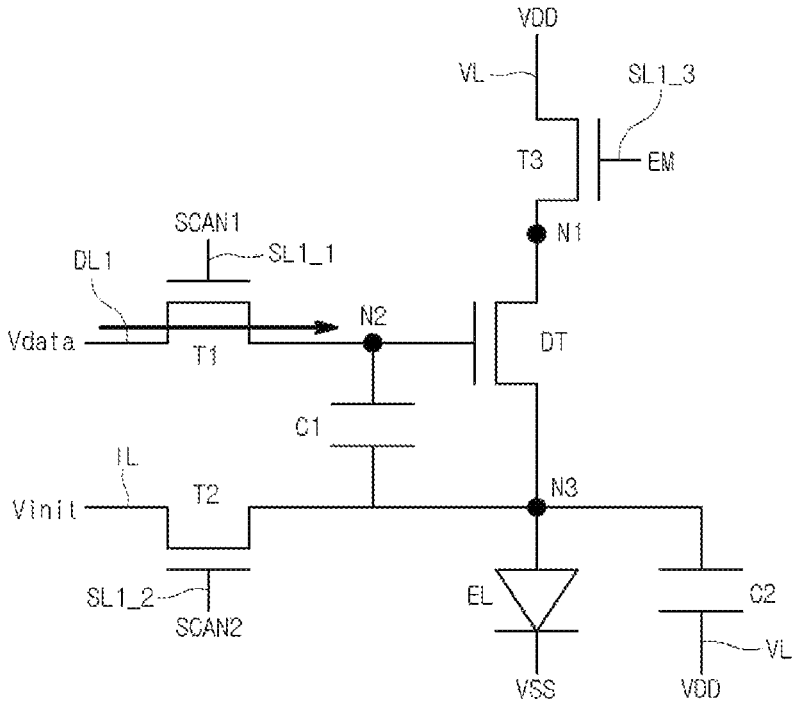
FIG. 6 shows operation of the pixel circuit shown in FIG. 3 in a data writing period.
Figure 6:
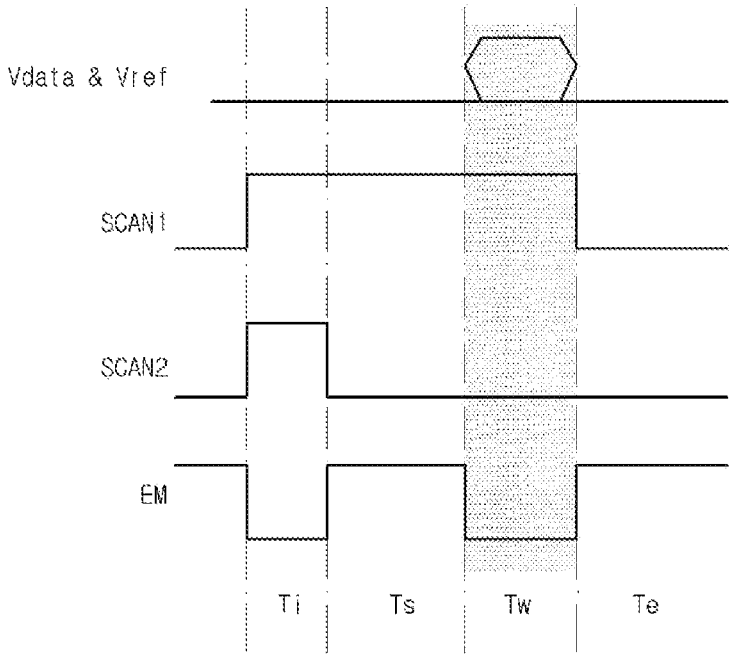

FIG. 6 shows that the pixel circuit shown in FIG. 3 operates in a data writing period.

During the data writing period Tw, the first scan signal SCAN1 is maintained in a high state, and the second scan signal SCAN2 is maintained in a low state. At the moment when the data writing period Tw starts, the light emission control signal EM falls and is maintained in a low state during the data writing period Tw. Accordingly, during the data writing period Tw, only the first transistor T1 is turned on, and the second transistor T2 and the third transistor T3 are turned off. Accordingly, the data voltage Vdata is supplied to the second node N2 through the turned-on first transistor T1, and the drain node and the source node of the driving transistor DT are floating.

As the data voltage Vdata is supplied to the second node N2 during the data writing period Tw, a voltage change amount of the second node N2 is voltage divided between the first capacitor C1 and the second capacitor C2. The voltage of the second node N2 is determined as a voltage-divided voltage value.

Specifically, the voltage change amount of the second node N2 is Vdata−Vref, and due to the voltage division between the first capacitor C1 and the second capacitor C2 connected in series, the voltage change amount at the second node N2 during the data writing period Tw is C1/(C1+C2)*(Vdata−Vref). That is, the voltage of the second node N2 is obtained by adding C1/(C1+C2)*(Vdata−Vref) that is the voltage change amount at the second node N2 during the data writing period Tw to Vref−Vth determined in the sampling period Ts. In other words, the voltage of the second node N2 in the data writing period Tw is (Vref−Vth)+C1/(C1+C2)*(Vdata−Vref), and Vgs of the driving transistor DT is addressed to C1/(C1+C2))*(Vdata−Vref)+Vth.

Light Emission Period Te

Figure 7:
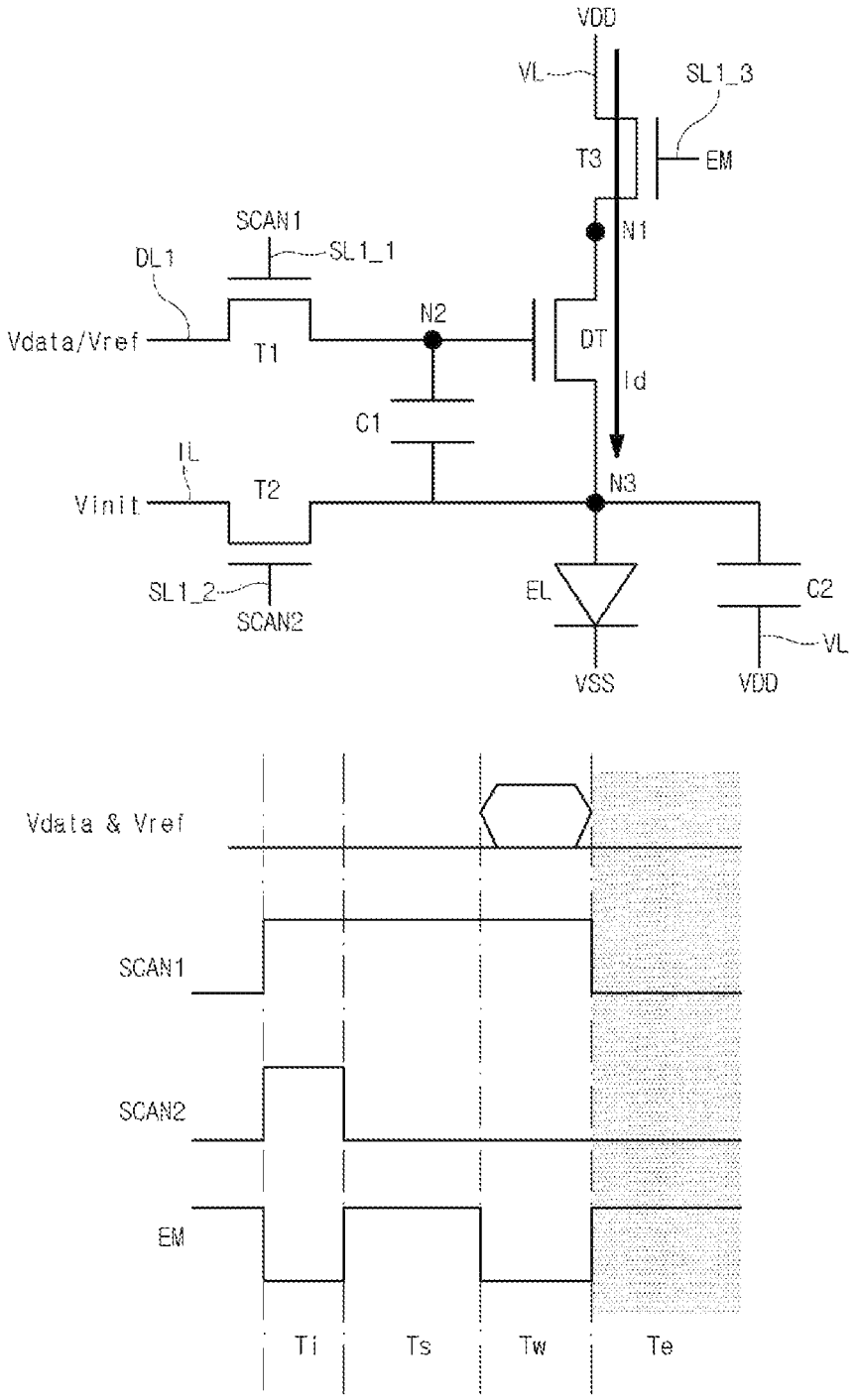
FIG. 7 shows operation of the pixel circuit shown in FIG. 3 in a light emission period.

FIG. 7 shows that the pixel circuit shown in FIG. 3 operates in a light emission period.

During the light emission period Te, the first scan signal SCAN1 is maintained in a low state, and the second scan signal SCAN2 is also maintained in a low state. At the moment when the light emission period Te starts, the light emission control signal EM rises and is maintained in a high state during the light emission period Te.

Accordingly, during the light emission period Te, the first transistor T1 and the second transistor T2 are turned off, and the third transistor T3 is turned on. Accordingly, the high potential voltage VDD is supplied to the drain node of the driving transistor DT through the turned-on third transistor T3, and an equality Vds>Vgs>Vth is obtained (Vds represents a voltage between the drain and the source of the driving transistor DT), so that a current flows through the light emitting element EL.

Specifically, during the light emission period Te, the current Id flowing through the light emitting element EL is controlled by Vgs of the driving transistor DT, and the light emitting element EL emits light by the current Id, so that the luminance is increased. As described above, the current Id flowing through the light emitting element EL during the light emission period Te is represented by the following Equation (1).

$$I_d = \frac{k}{2}[(1-c)\times(Vdata - Vref)]^2 \quad (1)$$

Here, k is a proportional constant which reflects various factors of the pixel circuit, and C=C1/(C1+C2), wherein C1 represents a capacitance of the first capacitor C1, and C2 represents a capacitance of the second capacitor C2. As for Equation (1), Vth is eliminated in Equation (1). That is, the current Id flowing through the light emitting element EL is not affected by the threshold voltage Vth of the driving transistor DT. Accordingly, by compensating the deviation of the driving transistor DT for each sub-pixel, it is possible to reduce the luminance deviation between sub-pixels to improve the image quality.

However, the circuit of the 4T2C sub-pixel according to the comparison example of FIG. 3 has the following problems.

Since the reference voltage Vref and the data voltage Vdata supplied to the gate node N2 of the driving transistor DT are supplied through one data line DL1, it is difficult to cope with high-speed driving and power consumption increases. This is because since there is a large amount of voltage change between the data voltage Vdata and the reference voltage Vref, a delay may occur due to an effect of a parasitic capacitor between each data line DL1, so that it is difficult to cope with high-speed driving. Also, there is a problem in that a large amount of voltage change between the data voltage Vdata and the reference voltage Vref causes power loss.

Figure 8:
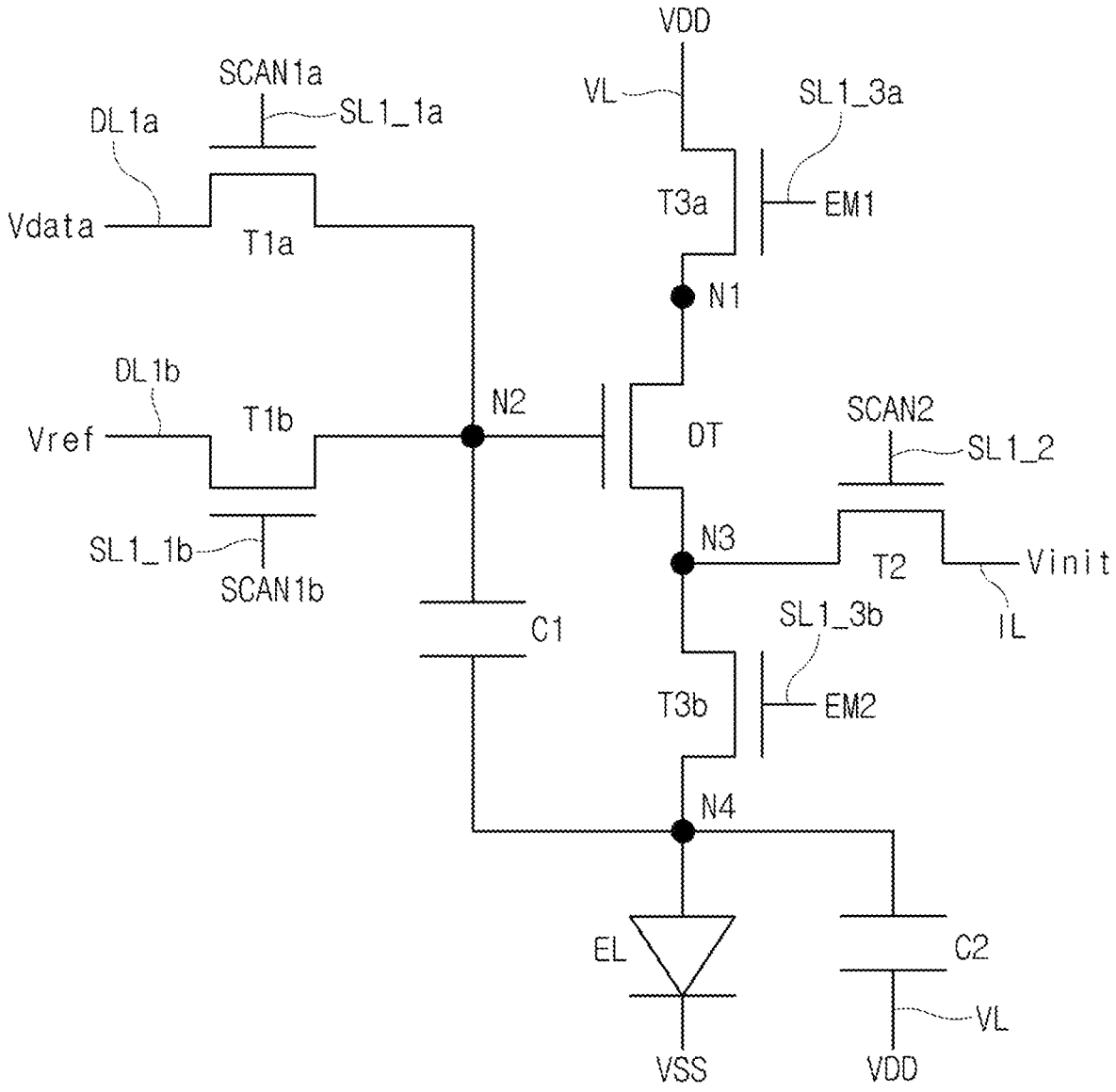
FIG. 8 is a circuit diagram of a 6T2C sub-pixel according to the embodiment.

FIG. 8 is a circuit diagram of a 6T2C sub-pixel according to the embodiment.

The sub-pixel SP included in the display panel 110 includes 6T (Transistor) and 2C (Capacitor) including the first to fifth transistors T1*a* to T3*b*, the light emitting element EL, the driving transistor DT, and the first and second capacitors C1 and C2.

As compared with the comparison example of FIG. 3, the 6T2C sub-pixel according to the embodiment of FIG. 8 is different from the comparison example of FIG. 3 in that the data lines which supplies the data voltage Vdata and the reference voltage Vref is separated into a first data line DL1*a* and a second data line DL1*b*. Since the data line can be driven while being separated into the first data line DL1*a* and the second data line DL1*b*, the charging and discharging time of data wiring is reduced, so that high-speed driving is allowed and power consumption can be reduced.

Also, there is a difference in that a 3-2th transistor T3*b* which controls the light emission of the light emitting element EL is added between the third node N3 and the light emitting element EL. That is, each sub-pixel may have a 3-1th transistor T3*a* and the 3-2th transistor T3*b* coupled in series with the driving transistor DT and the light emitting element EL. When the 3-1th transistor T3*a* and the 3-2th transistor T3*b* which control the light emission of the light emitting element EL are individually controlled, an on-bias stress OBS can be applied effectively to the driving transistor DT of the sub-pixel.

Hereinafter, a connection relationship between components included in the sub-pixel SP according to the embodiment of FIG. 8 and their roles will be briefly described as follows.

The driving transistor DT includes a gate node that is the second node N2, a source node that is the third node N3, and a drain node that is the first node N1.

The first node N1 is connected to the 3-1th transistor T3*a*. Then, the drain node of the driving transistor DT is electrically connected to the high potential voltage VDD through the power wiring VL.

The second node N2 is connected to a 1-1th transistor T1*a*, a 1-2th transistor T1*b*, and the first capacitor C1. The second node N2 is electrically connected to the first data line DL1*a* which is connected to the source node of the 1-1th transistor T1*a* and supplies the data voltage Vdata. Also, the second node N2 is electrically connected to the second data line DL1*b* which is connected to the source node of the 1-2th transistor T1*b* and supplies the reference voltage Vref.

The third node N3 is connected to the second transistor T2 and the third-second transistor T3*b*. The third node N3 is electrically connected to the initialization voltage line IL which is connected to the source node of the second transistor T2 and supplies the initialization voltage Vinit. Also, the third node N3 is connected to the drain node of the 3-2th transistor T3*b*.

The 1-1th transistor T1*a* includes a gate node connected to a 1-1th scan line SL1_1*a*, a drain node connected to the first data line DL1*a*, and a source node that is the second node N2 connected to the driving transistor DT. Specifically, the 1-1th transistor T1*a* is turned on or turned off by a 1-1th scan signal SCAN1*a*. The drain node of the 1-1th transistor T1*a* is connected to the first data line DL1*a* to supply the data voltage Vdata to the gate node of the driving transistor DT connected to the second node N2.

The 1-2th transistor T1*b* includes a gate node connected to a 1-2th scan line SL1_1*b*, a drain node connected to the second data line DL1*b*, and a source node that is the second node N2 connected to the driving transistor DT. Specifically, the 1-2th transistor T1*b* is turned on or turned off by a 1-2th scan signal SCAN1*b*. The drain node of the 1-2th transistor T1*b* is connected to the second data line DL1*b* to supply the reference voltage Vref to the gate node of the driving transistor DT connected to the second node N2.

The second transistor T2 includes a gate node connected to the second scan line SL1_2, a drain node connected to the initialization voltage line IL, and a source node that is the third node N3 connected to the source node of the driving transistor DT. Specifically, the second transistor T2 is turned on or turned off by the second scan signal SCAN2. The drain node of the second transistor T2 is connected to the initialization voltage line IL to supply the initialization voltage Vinit to the source node of the driving transistor DT connected to the third node N3.

The 3-1th transistor T3*a* includes a gate node connected to a 3-1th scan line SL1_3*a*, a drain node connected to the high potential voltage VDD, and a source node that is the first node N1 connected to the drain node of the driving transistor DT. Specifically, the 3-1th transistor T3*a* is turned on or turned off by a first light emission control signal EM1. The drain node of the 3-1th transistor T3*a* is connected to the power wiring VL to supply the high potential voltage VDD to the drain node of the driving transistor DT connected to the first node N1.

The 3-2th transistor T3*b* includes a gate node connected to a 3-2th scan line SL1_3*b*, a drain node that is the third node N3 connected to the source node of the driving transistor DT, and a source node that is a fourth node N4 connected to the light emitting element. The electrode of the light emitting element connected to the fourth node N4 may be an anode electrode. Specifically, the 3-2th transistor T3*b* is turned on or off by a second light emission control signal EM2.

The two capacitors may be storage capacitors for storing a voltage applied to the gate node or the source node of the driving transistor DT. Also, the two capacitors are connected in series at the fourth node N4.

The first capacitor C1 is electrically connected to the second node N2 that is the gate nodes of the driving transistor DT and the fourth node N4. The third node N3 and the fourth node N4 may be electrically connected as the 3-2th transistor T3*b* is turned on. Accordingly, the first capacitor C1 may store a voltage equal to a difference between the voltages applied to the second node N2 and the third node N3.

The second capacitor C2 is electrically connected to the fourth node N4 and the high potential voltage VDD. The third node N3 and the fourth node N4 may be electrically connected as the 3-2th transistor T3*b* is turned on. Also, the second capacitor C2 is connected in series with the first capacitor C1 at the fourth node N4. Accordingly, the second capacitor C2, together with the first capacitor C1, stores a voltage by voltage-division.

The sub-pixel SP according to the embodiment of FIG. 8 emits light after going through an on-bias stress (OBS) operation, an initialization operation (Initial), a sampling operation (Sampling), and a data writing operation (Data Writing). This will be described in detail as follows.

On-Bias Stress (OBS) Period

Figure 9:
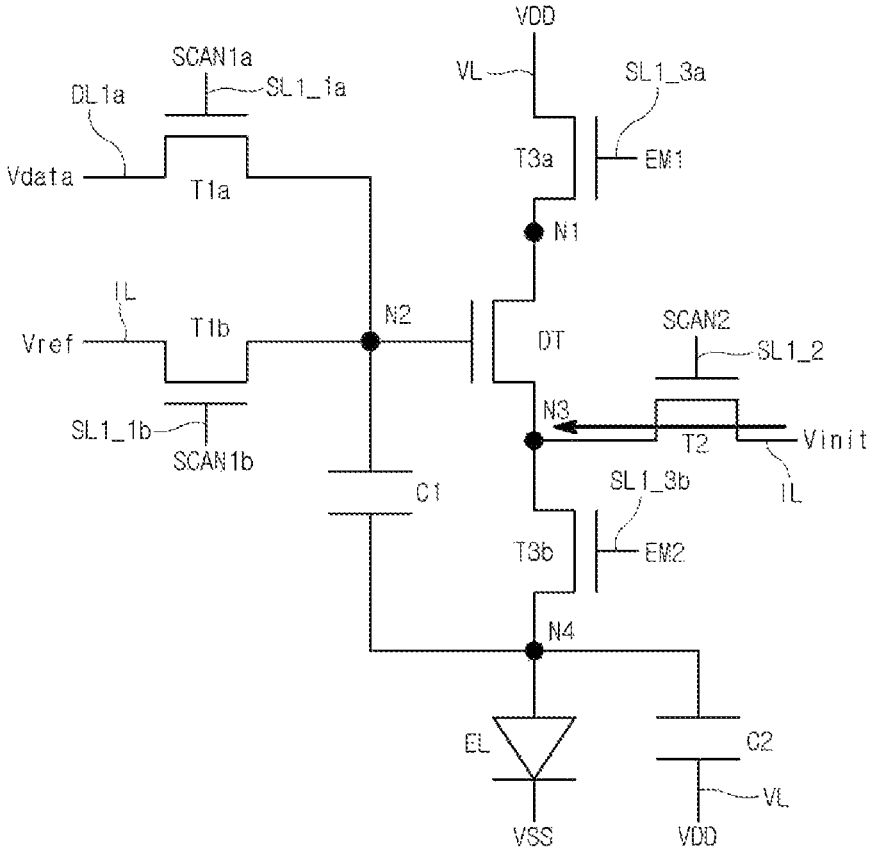
FIG. 9 shows operation of the pixel circuit shown in FIG. 8 in an on-bias stress period.
Figure 9:
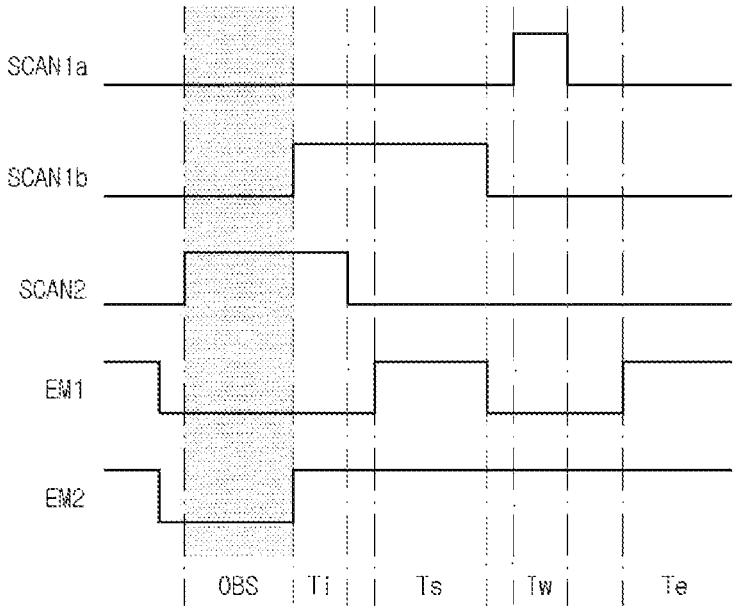

FIG. 9 shows that the pixel circuit shown in FIG. 8 operates in an on-bias stress period.

As compared with the comparison example of FIG. 3, the 6T2C sub-pixel according to the embodiment of FIG. 8 is different from the comparison example of FIG. 3 in that the 3-2th transistor which controls the light emission of the light emitting element EL is added between the third node N3 and the light emitting element EL. When the 3-1th transistor T3*a* and the 3-2th transistor T3*b* which control the light emission of the light emitting element EL are individually controlled, the on-bias stress OBS can be applied effectively to the driving transistor DT of the sub-pixel.

The threshold voltage of the driving transistor DT may change according to a current value corresponding to the gate-source voltage Vgs of the driving transistor DT. For example, the threshold voltage of the driving transistor DT may show a first average level when the Vgs is rising from low to high, and may show a second average level different from the first average level when the Vgs is falling from high to low. This dependence of the threshold voltage on the Vgs value is sometimes referred to as transistor "hysteresis".

The on-bias stress operation is to prevent flicker caused by hysteresis by periodically applying the turn-on bias to the driving transistor DT in order to suppress the fluctuation in the threshold voltage Vth of the driving transistor DT due to such "hysteresis" characteristics.

Therefore, performing the on-bias stress operation in order to bias the Vgs of the driving transistor DT to a specific voltage before sampling the threshold voltage Vth of the driving transistor DT reduces the hysteresis and helps improve a first frame response. Accordingly, the on-bias stress operation can be defined as an operation to directly applying a suitable bias voltage to the driving transistor DT during non-light emission phases.

The on-bias stress operation should be performed before the sampling period. According to various embodiments, the on-bias stress operation may be performed before the initialization period or between the initialization period and the sampling period. While in the present disclosure, the example has been provided in which the on-bias stress operation is performed before the initialization period, the spirit of the present disclosure is not limited thereto.

At the moment when the on-bias stress period (or bias period) starts, the 1-1th scan signal SCAN1*a* and the 1-2th scan signal SCAN1*b* are in a low state. The second scan signal SCAN2 rises to become in a high state, and at the same time, the first and second light emission control signals fall to become in a low state.

Accordingly, during the on-bias stress period, the second transistor T2 is turned on, and the 1-1th transistor T1*a*, the 1-2th transistor T1*b*, the 3-1th transistor T3*a*, and the 3-2th transistor T3*b* are turned off. Accordingly, the initialization voltage Vinit is supplied to the third node N3 from the initialization line by the second transistor T2.

Initialization Period Ti

Figure 10:
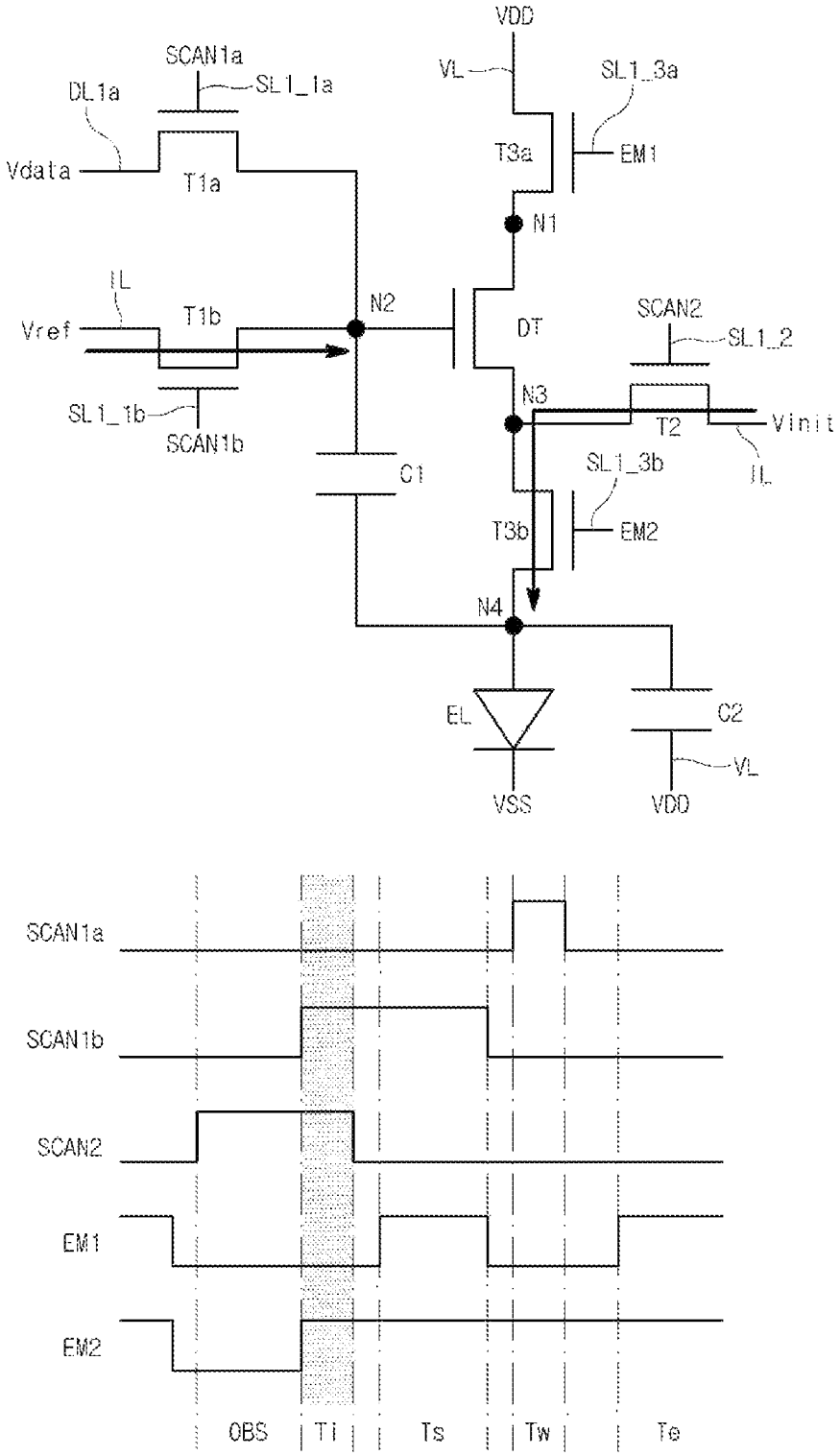
FIG. 10 shows operation of the pixel circuit shown in FIG. 8 in the initial period.

FIG. 10 shows that the pixel circuit shown in FIG. 8 operates in the initial period.

At the moment when the initialization period Ti starts, the 1-2th scan signal SCAN1*b* and the second light emission control signal EM2 rise to become in a high state. The second scan signal SCAN2 is maintained in a high state. At the same time, the 1-1th scan signal SCAN1*a* and the first light emission control signal EM1 are maintained in a low state.

Accordingly, during the initialization period Ti, the 1-2th transistor T1*b*, the second transistor T2, and the 3-2th transistor T3*b* are turned on, and the 1-1th transistor T1*a* and the 3-1th transistor T3*a* are turned off. Accordingly, the reference voltage Vref is supplied to the second node N2 from the second data line DL1*b*. Also, the initialization voltage Vinit is supplied to the third node N3 from the initialization voltage line IL by the second transistor T2. Also, the initialization voltage Vinit is supplied to the fourth node N4 through the 3-2th transistor T3*b*.

That is to say, as the initialization voltage Vinit is supplied to the third node N3 that is the source nodes of the driving transistor DT and the fourth node N4, the data voltage Vdata written in the light emitting element EL is initialized.

Also, since the voltage applied to the second node N2 is the reference voltage Vref and the voltage applied to the third node N3 is the initialization voltage Vinit, the voltage Vgs of the driving transistor DT is biased to a specific voltage value "Vref−Vinit". Accordingly, the hysteresis of the driving transistor DT is reduced.

Sampling Period Ts

Figure 11:
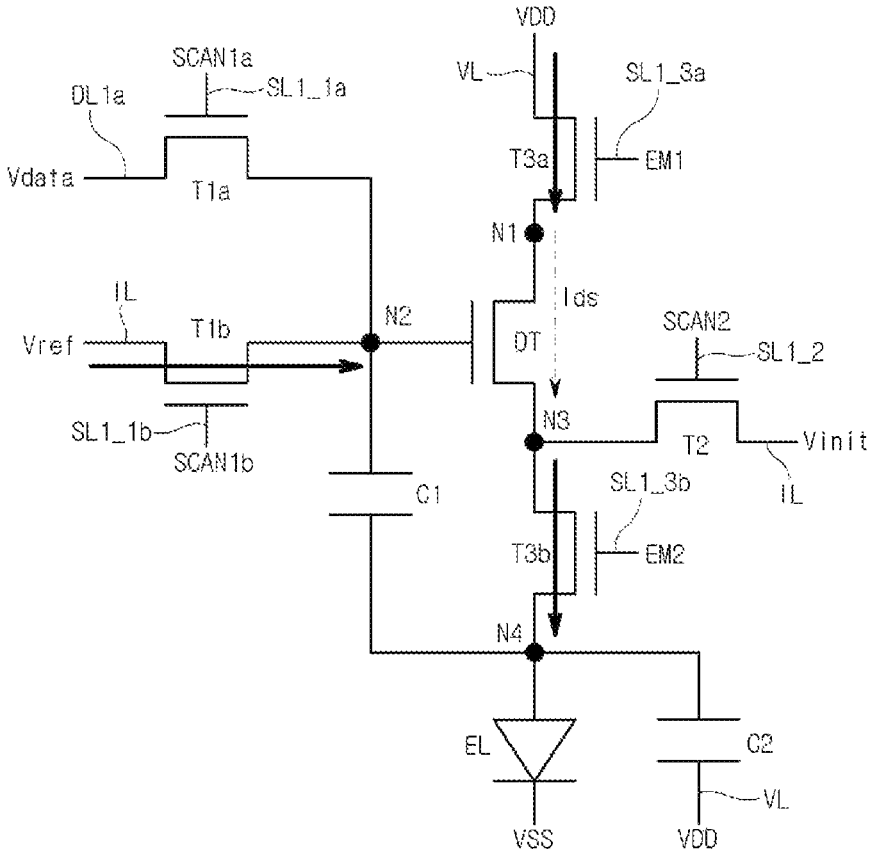
FIG. 11 shows operation of the pixel circuit shown in FIG. 8 in the sampling period.
Figure 11:
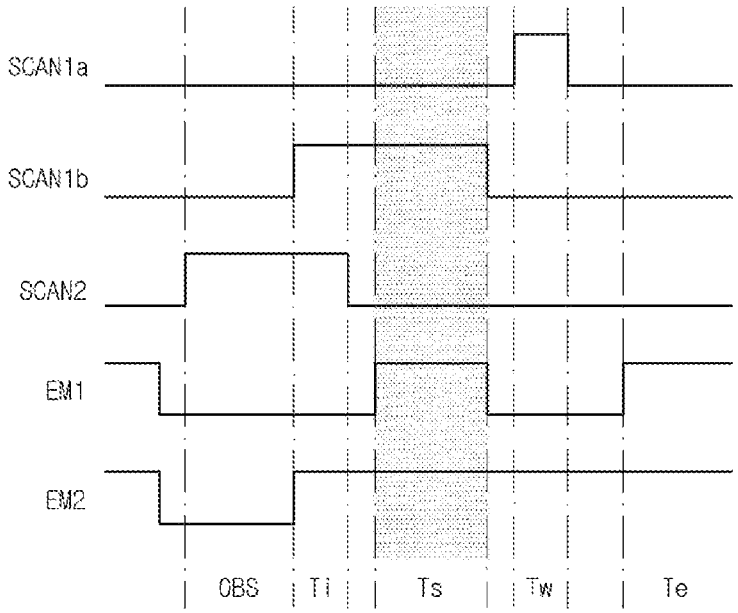

FIG. 11 shows that the pixel circuit shown in FIG. 8 operates in the sampling period.

During the sampling period Ts, the first light emission control signal EM1 rises to become in a high state, and the 1-2th scan signal SCAN1*b* and the second light emission control signal EM2 are maintained in a high state. At the same time, the 1-1th scan signal SCAN1*a* and the second scan signal SCAN2 are maintained in a low state.

Accordingly, during the sampling period, the 1-2th transistor T1*b*, the 3-1th transistor T3*a*, and the 3-2th transistor T3*b* are turned on, and the 1-1th transistor T1*a* and the second transistor T2 are turned off.

Accordingly, the reference voltage Vref is supplied to the second node N2, and the high potential voltage VDD is supplied to the first node N1. Since the 3-2th transistor T3*b* is in a turned-on state, the third node N3 and the fourth node N4 have the same voltage value. During the sampling period Ts, the voltages of the third node N3 and the fourth node N4 are increased by a current between the drain and the source (hereinafter, referred to as Ids) of the driving transistor DT. Here, a voltage between the gate and the source (hereinafter, referred to as Vgs) of the driving transistor DT is sampled as the threshold voltage Vth of the driving transistor DT in a source follower manner. The thus sampled threshold voltage Vth of the driving transistor DT is stored in the first capacitor C1. Accordingly, during the sampling period Ts, the voltage of the second node N2 is the reference voltage Vref, and the voltages of the third node N3 and the fourth node N4 are Vref−Vth.

Data Writing Period Tw

Figure 12:
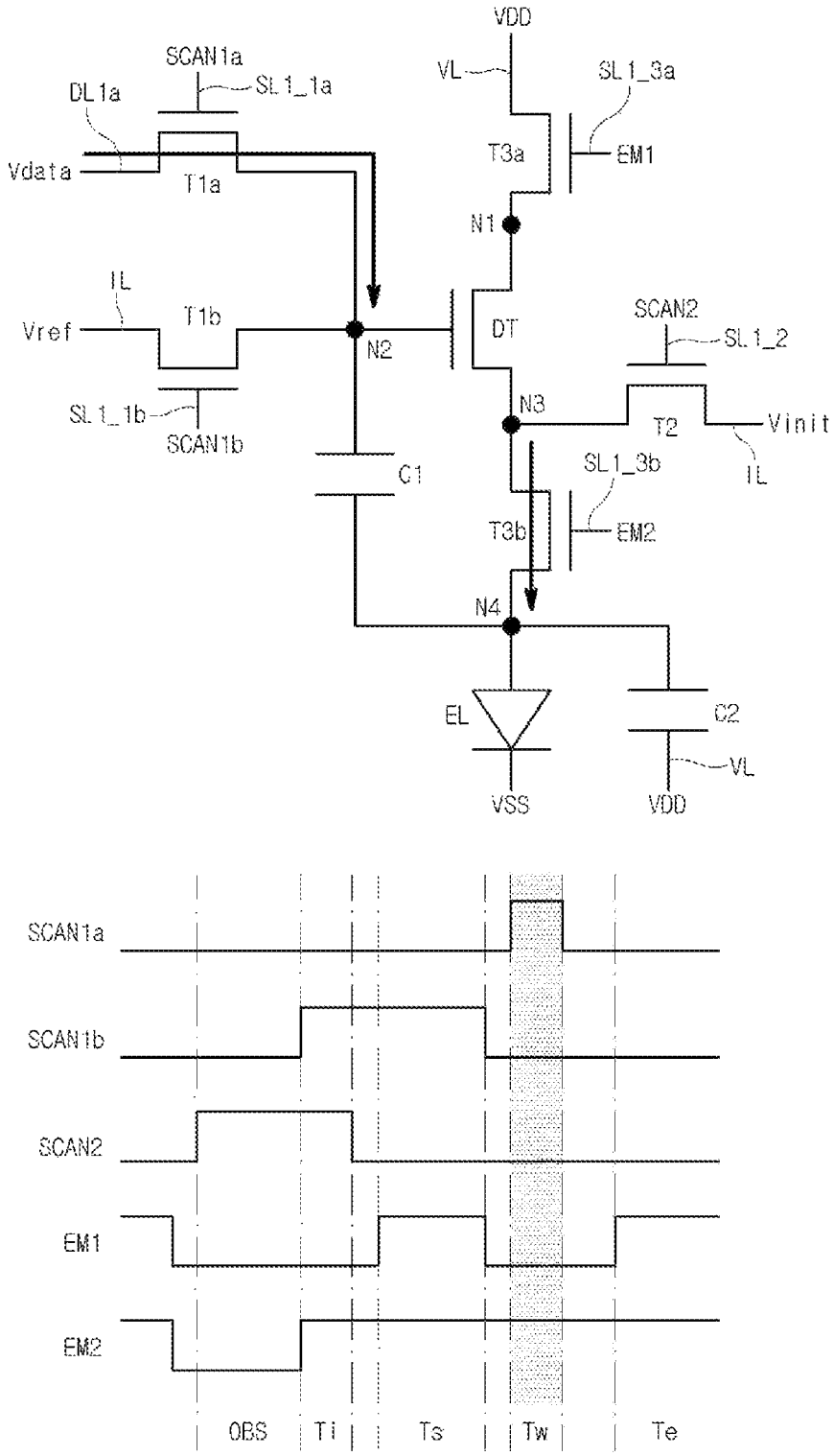
FIG. 12 shows operation of the pixel circuit shown in FIG. 8 in the data writing period.

FIG. 12 shows that the pixel circuit shown in FIG. 8 operates in the data writing period.

During the data writing period, the 1-1th scan signal SCAN1*a* rises to become in a high state. At the same time, the second light emission control signal EM2 is maintained in a high state, and the 1-2th scan signal SCAN1*b*, the second scan signal SCAN2, and the first light emission control signal EM1 are in a low state.

Accordingly, during the data writing period, the 1-1th transistor T1*a* and the 3-2th transistor T3*b* are turned on, and the 1-2th transistor T1*b*, the 3-1th transistor T3*a*, and the second transistor T2 are in a turned-off state. Accordingly, the turned-on data voltage Vdata is supplied to the second node N2, and the first node N1 and the third node N3 are floating. Since the 3-2th transistor T3*b* is in the turned-on state, the third node N3 and the fourth node N4 have the same voltage value.

As the data voltage Vdata is supplied to the second node N2 during the data writing period Tw, a voltage change amount of the second node N2 is voltage divided between the first capacitor C1 and the second capacitor C2. The voltage of the second node N2 is determined as a voltage-divided voltage value.

Specifically, the voltage change amount of the second node N2 is Vdata−Vref, and due to the voltage division between the first capacitor C1 and the second capacitor C2 connected in series, the voltage change amount at the second node N2 during the data writing period Tw is C1/(C1+C2)*(Vdata−Vref). That is, the voltage of the second node N2 is obtained by adding C1/(C1+C2)*(Vdata−Vref) that is the voltage change amount at the second node N2 during the data writing period Tw to Vref−Vth determined in the sampling period Ts. In other words, the voltage of the second node N2 in the data writing period Tw is (Vref−Vth)+C1/(C1+C2)*(Vdata−Vref), and Vgs of the driving transistor DT is addressed to C1/(C1+C2))*(Vdata−Vref)+Vth.

Light Emission Period Te

Figure 13:
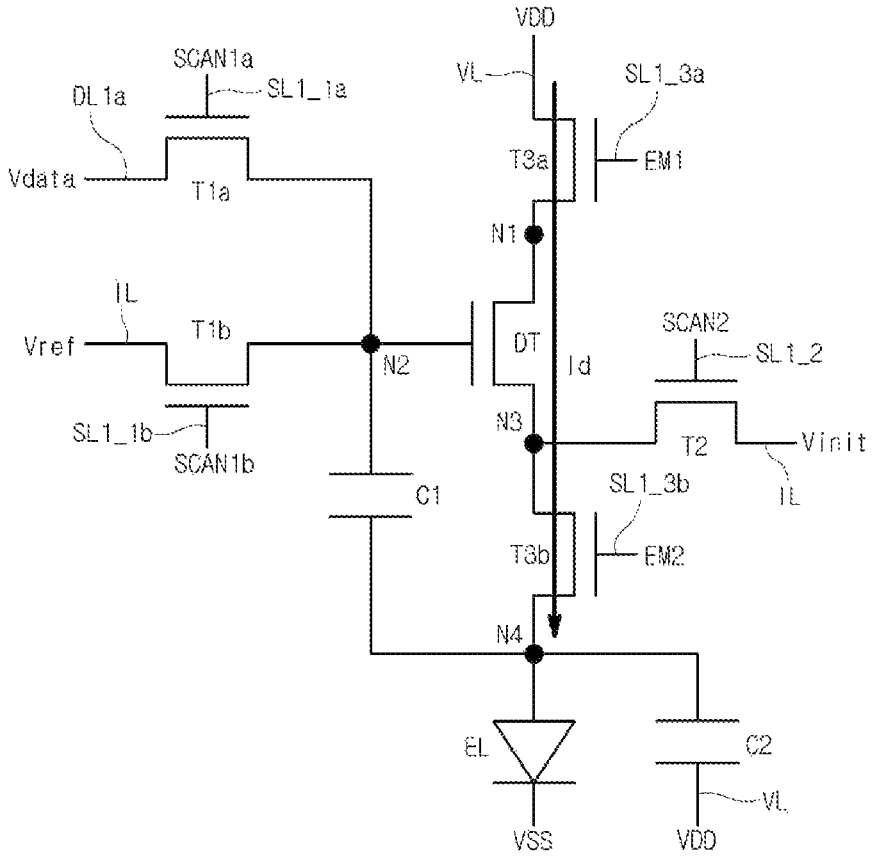
FIG. 13 shows operation of the pixel circuit shown in FIG. 8 in the light emission period.
Figure 13:
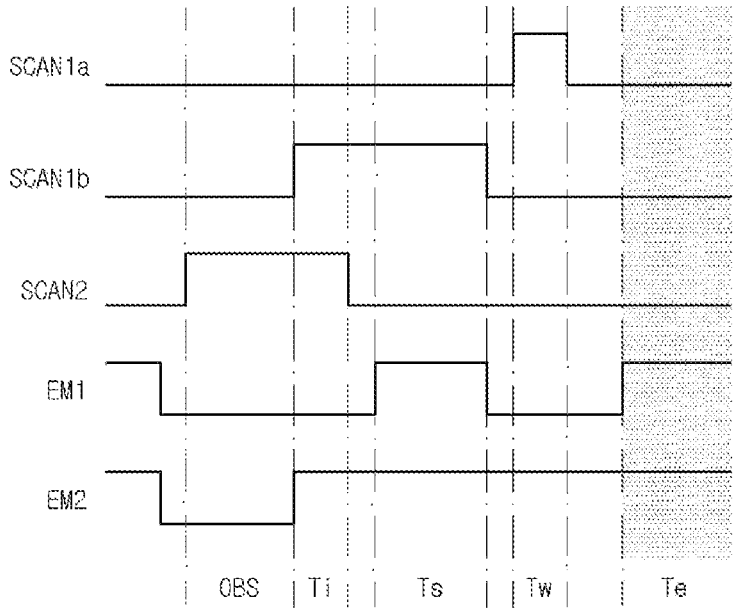

FIG. 13 shows that the pixel circuit shown in FIG. 8 operates in the light emission period.

During the light emission period, the 1-1th scan signal SCAN1*a* and the 1-2th scan signal SCAN1*b* are maintained in a low state, and the second scan signal SCAN2 is also maintained in a low state. At the moment when the light emission period starts, the first light emission control signal rises and is maintained in a high state during the light emission period, and the second light emission control signal is also maintained in a high state during the light emission period.

Accordingly, during the light emission period Te, the 1-1th transistor T1*a*, the 1-2th transistor T1*b*, and the second transistor T2 are turned off, and the 3-1th transistor T3*a* and the 3-2th transistor T3*b* are turned on. Accordingly, the high potential voltage VDD is supplied to the drain node N1 of the driving transistor DT, an equality Vds>Vgs>Vth is obtained, so that a current flows through the light emitting element EL.

Specifically, during the light emission period Te, the current Id flowing through the light emitting element EL is controlled by Vgs of the driving transistor DT, and the light emitting element EL emits light by the current Id, so that the luminance is increased. As described above, the current Id flowing through the light emitting element EL during the light emission period Te is represented by the equation (1) described with reference to FIG. 7.

$$I_d = \frac{k}{2}[(1-c)\times(Vdata - Vref)]^2$$

As described above, the display device according to the embodiment can be driven at a high speed and can reduce power consumption by separating data lines that supply a data voltage and a reference voltage. Also, in the display device according to the embodiment, a plurality of transistors that control the light emission of a light emitting element are individually controlled, so that on-bias stress which alleviates hysteresis of a driving transistor can be driven.

While the embodiment of the present disclosure has been described with reference to the accompanying drawings, it can be understood by those skilled in the art that the present disclosure can be embodied in other specific forms without departing from its spirit or characteristics. Therefore, the foregoing embodiments and advantages are merely and are not to be construed as limiting the present disclosure. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a display panel in which a plurality of scan lines, a plurality of data lines, and a plurality of sub-pixels are disposed;

a scan driver configured to drive the plurality of scan lines; and a data driver configured to drive the plurality of data lines, wherein each of the plurality of sub-pixels includes:

a light emitting element;

a driving transistor having a first node electrically connected to a high potential voltage, a second node that is a gate node, and a third node electrically connected to an anode electrode of the light emitting element;

a first transistor electrically connected between the first node and the high potential voltage;

a second transistor electrically connected between the second node and a first data line;

a third transistor electrically connected between the second node and a second data line;

a fourth transistor electrically connected between the third node and an initialization voltage line;

a first capacitor having a first electrode electrically connected to the second node and a second electrode electrically connected to the anode electrode; and a second capacitor having a first electrode electrically connected to the high potential voltage and a second electrode electrically connected to the anode electrode, wherein the sub-pixel receives input signals during a refresh period and a horizontal holding period, wherein the refresh period includes at least a first period and a second period, and wherein the refresh period includes a bias period before the second period, and during the bias period, the first transistor is turned off, the second transistor is turned off, the third transistor is turned off and the fourth transistor is turned on.

2. The display device of claim 1, wherein the sub-pixel refresh period further comprises a third period.

3. The display device of claim 2, wherein, during the first period, the second transistor is turned off, the third transistor is turned on, the fourth transistor is turned on, and the first transistor is turned off.

4. The display device of claim 2, wherein, during the second period, the second transistor is turned off, the third transistor is turned on, the fourth transistor is turned off, and the first transistor is turned on.

5. The display device of claim 2, wherein, during the third period, the second transistor is turned on, the third transistor is turned off, the fourth transistor is turned off, and the first transistor is turned off.

6. The display device of claim 2, wherein, during the horizontal holding period, the second transistor, the third transistor, and the fourth transistor are turned off, and the first transistor is turned on.

7. The display device of claim 2, wherein each of the sub-pixels further comprises a fifth transistor electrically connected between the third node and the anode electrode.

8. The display device of claim 7, wherein the fifth transistor is turned off during the bias period.

9. The display device of claim 8, wherein the bias period is between the first period and the second period.

10. The display device of claim 8, wherein the bias period is before the first period.

11. The display device of claim 7, wherein during the fourth period, the fifth transistor is turned on, and a high potential voltage is supplied to the first node of the driving transistor.

12. A display device comprising:

a display panel in which a plurality of scan lines, a plurality of data lines, and a plurality of sub-pixels are disposed;

a scan driver configured to drive the plurality of scan lines; and a data driver configured to drive the plurality of data lines, wherein each of the plurality of sub-pixels includes:

a light emitting element;

a driving transistor having a first node electrically connected to a high potential voltage, a second node that is a gate node, and a third node electrically connected to an anode electrode of the light emitting element;

a first transistor electrically connected between the first node and the high potential voltage;

a second transistor electrically connected between the second node and a first data line;

a third transistor electrically connected between the second node and a second data line;

a fourth transistor electrically connected between the third node and an initialization voltage line;

a fifth transistor electrically connected between the third node and the anode electrode; and a first capacitor having a first electrode electrically connected to the second node and a second electrode electrically connected to the anode electrode, wherein the sub-pixel receives input signals during a refresh period and a horizontal holding period, wherein the refresh period includes at least a first period and a second period, and wherein during the first period, the fifth transistor is turned on, a reference voltage is supplied to the second node from the second data line, and an initialization voltage is supplied to the third node from an initialization voltage line by the second transistor.

13. The display device of claim 12 further comprising:

a second capacitor having a first electrode electrically connected to the high potential voltage and a second electrode electrically connected to the anode electrode.

14. A display device comprising:

a display panel in which a plurality of scan lines, a plurality of data lines, and a plurality of sub-pixels are disposed;

a scan driver configured to drive the plurality of scan lines; and a data driver configured to drive the plurality of data lines, wherein each of the plurality of sub-pixels includes:

a light emitting element;

a driving transistor having a first node electrically connected to a high potential voltage, a second node that is a gate node, and a third node electrically connected to an anode electrode of the light emitting element;

a first transistor electrically connected between the first node and the high potential voltage;

a second transistor electrically connected between the second node and a first data line;

a third transistor electrically connected between the second node and a second data line;

a fourth transistor electrically connected between the third node and an initialization voltage line;

a fifth transistor electrically connected between the third node and the anode electrode; and a first capacitor having a first electrode electrically connected to the second node and a second electrode electrically connected to the anode electrode, wherein the sub-pixel receives input signals during a refresh period and a horizontal holding period, and wherein the refresh period includes at least a first period and a second period, and wherein during the second period, the fifth transistor is turned on, a reference voltage is supplied to the second node, and a high potential voltage is supplied to the first node.

15. The display device of claim 14 further comprising:

a second capacitor having a first electrode electrically connected to the high potential voltage and a second electrode electrically connected to the anode electrode.

16. A display device comprising:

a display panel in which a plurality of scan lines, a plurality of data lines, and a plurality of sub-pixels are disposed;

a scan driver configured to drive the plurality of scan lines; and a data driver configured to drive the plurality of data lines, wherein each of the plurality of sub-pixels includes:

a light emitting element;

a driving transistor having a first node electrically connected to a high potential voltage, a second node that is a gate node, and a third node electrically connected to an anode electrode of the light emitting element;

a first transistor electrically connected between the first node and the high potential voltage;

a second transistor electrically connected between the second node and a first data line;

a third transistor electrically connected between the second node and a second data line;

a fourth transistor electrically connected between the third node and an initialization voltage line;

a fifth transistor electrically connected between the third node and the anode electrode; and a first capacitor having a first electrode electrically connected to the second node and a second electrode electrically connected to the anode electrode, wherein the sub-pixel receives input signals during a refresh period and a horizontal holding period, wherein the refresh period includes at least a first period, a second period and a third period, wherein during the third period, the fifth transistor is turned on, a data voltage is supplied to the second node, and the first node and the third node are floating.

17. A display device comprising:

a display panel having a plurality of scan lines, a plurality of data lines, and a plurality of sub-pixels;

a scan driver configured to drive the plurality of scan lines; and a data driver configured to drive the plurality of data lines, wherein each of the plurality of sub-pixels includes:

a light emitting element;

a driving transistor having a first node electrically connected to a high potential voltage, a second node that is a gate node, and a third node electrically connected to an anode electrode of the light emitting element;

a first transistor electrically connected between the first node and the high potential voltage;

a second transistor electrically connected between the second node and a first data line;

a third transistor electrically connected between the second node and a second data line;

a fourth transistor electrically connected between the third node and an initialization voltage line; and a first capacitor having a first electrode electrically connected to the second node and a second electrode electrically connected to the anode electrode, wherein the sub-pixel receives input signals during a refresh period and a light emission period, and wherein the refresh period includes a bias period, first period, a second period, and third period, and the bias period is before the second period, wherein during the bias period, the first transistor is turned off, the second transistor is turned off, the third transistor is turned off and the fourth transistor is turned on;

wherein during the first period, and the first transistor is turned off, the second transistor is turned off, the third transistor is turned on and the fourth transistor is turned on, wherein during the second period, the first transistor is turned on, the second transistor is turned off, the third transistor is turned on and the fourth transistor is turned off.

18. The display device of claim 17 further including:

a fifth transistor electrically connected between the third node and the anode electrode; and wherein during the bias period the fifth transistor is turned off, and during the first period the fifth transistor is turned on.

19. The display device of claim 18 wherein during the second period the fifth transistor is turned on.

20. The display device of claim 19 wherein during the light emission period the first transistor is turned on, the second transistor is turned off, the third transistor is turned off, the fourth transistor is turned off and the fifth transistor is turned on.

21. The display device of claim 18 wherein during the third period the first transistor is turned off, the second transistor is turned on, the third transistor is turned off, the fourth transistor is turned off and the fifth transistor is turned on.

22. The display device of claim 17 further comprising:

a second capacitor having a first electrode electrically connected to the high potential voltage and a second electrode electrically connected to the anode electrode.

* * * * *